US008899339B2

(12) United States Patent
Tolman et al.

(10) Patent No.: US 8,899,339 B2
(45) Date of Patent: Dec. 2, 2014

(54) SYSTEMS AND METHODS FOR REGULATING FLOW IN A WELLBORE

(75) Inventors: Randy C. Tolman, Spring, TX (US); Timothy G. Benish, Pearland, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 442 days.

(21) Appl. No.: 12/812,197

(22) PCT Filed: Jan. 16, 2009

(86) PCT No.: PCT/US2009/031261

§ 371 (c)(1),
(2), (4) Date: Jul. 8, 2010

(87) PCT Pub. No.: WO2009/108413

PCT Pub. Date: Sep. 3, 2009

(65) Prior Publication Data

US 2010/0276160 A1 Nov. 4, 2010

Related U.S. Application Data

(60) Provisional application No. 61/067,580, filed on Feb. 29, 2008.

(51) Int. Cl.

| | |
|---|---|
| ***E21B 43/12*** | (2006.01) |
| ***E21B 33/124*** | (2006.01) |
| ***E21B 43/14*** | (2006.01) |
| ***E21B 33/10*** | (2006.01) |

(52) U.S. Cl.

CPC ..... *E21B 43/14* (2013.01); *E21B 33/10* (2013.01); *E21B 43/12* (2013.01)

USPC ..... 166/386; 166/186; 166/313

(58) Field of Classification Search

USPC ..... 166/313, 242.5, 185, 186, 386

See application file for complete search history.

(56) References Cited

U.S. PATENT DOCUMENTS

| | | | |
|---|---|---|---|
| 1,544,757 | A | 7/1925 | Hufford et al. |
| 1,710,998 | A | 4/1929 | Rudkin |

(Continued)

FOREIGN PATENT DOCUMENTS

| | | | |
|---|---|---|---|
| DE | 79 09 727 | | 7/1979 |
| DE | 43 16 973 | A1 | 11/1994 |

(Continued)

OTHER PUBLICATIONS

Pehoda, G.D., "Expandables in wellbore design," Expandables & Tubular Technology, Jun. 2006, 2 pages.

(Continued)

*Primary Examiner* — Robert E Fuller

(74) *Attorney, Agent, or Firm* — ExxonMobil Upstream Research Company—Law Department

(57) ABSTRACT

Isolation systems for use in a wellbore include two or more tubular segments and at least one coupling assembly. The at least one coupling system is adapted to couple the first and second tubular segments together. The at least one coupling system is further adapted to block at least a portion of the wellbore annulus. The at least one coupling system is further configured as a leaky isolation assembly to separate the wellbore annulus into at least two isolated zones when disposed in the wellbore. At least one isolation zone has at least two outlets including a first outlet through an opening into the tubular and a second outlet past the leaky isolation assembly. The isolation system is configured to provide the isolation with hydraulics during well operation that preferentially drives fluids through the first outlet and at least substantially prevents fluid from passing the isolation assembly.

41 Claims, 9 Drawing Sheets

(56) References Cited

U.S. PATENT DOCUMENTS

| | | | | |
|---|---|---|---|---|
| 2,618,340 | A * | 11/1952 | Lynd | 166/250.08 |
| 2,815,935 | A | 12/1957 | Sedlmayr | |
| 2,847,189 | A | 8/1958 | Shook | |
| 3,112,802 | A | 12/1963 | Amann et al. | |
| 3,731,753 | A | 5/1973 | Weber | |
| 3,967,689 | A | 7/1976 | Cherrington | |
| 4,274,496 | A | 6/1981 | Liljekvist et al. | |
| 4,301,876 | A | 11/1981 | Harrison et al. | |
| 5,623,993 | A | 4/1997 | Van Buskirk et al. | |
| 5,687,805 | A | 11/1997 | Perry | |
| 5,803,178 | A | 9/1998 | Cain | |
| 5,921,331 | A | 7/1999 | Randall | |
| 6,343,651 | B1 | 2/2002 | Bixenman | |
| 6,394,184 | B2 | 5/2002 | Tolman et al. | |
| 6,494,265 | B2 | 12/2002 | Wilson et al. | |
| 6,520,255 | B2 | 2/2003 | Tolman et al. | |
| 6,543,538 | B2 | 4/2003 | Tolman et al. | |
| 6,575,247 | B2 | 6/2003 | Tolman et al. | |
| 6,575,250 | B1 | 6/2003 | Wijsman | |
| 6,672,405 | B2 | 1/2004 | Tolman et al. | |
| 6,755,247 | B2 * | 6/2004 | Moake et al. | 166/250.07 |
| 6,857,476 | B2 | 2/2005 | Richards | |
| 6,880,650 | B2 | 4/2005 | Hoffmaster et al. | |
| 6,957,701 | B2 | 10/2005 | Tolman et al. | |
| 7,055,598 | B2 | 6/2006 | Ross et al. | |
| 7,059,407 | B2 | 6/2006 | Tolman et al. | |
| 7,225,878 | B2 | 6/2007 | Holcomb et al. | |
| 7,261,161 | B2 | 8/2007 | Richards et al. | |
| 7,290,606 | B2 | 11/2007 | Coronado et al. | |
| 7,303,023 | B2 | 12/2007 | Harrall et al. | |
| 2001/0018977 | A1 | 9/2001 | Kilgore | |
| 2003/0024704 | A1 | 2/2003 | Hirsch et al. | |
| 2003/0066652 | A1 | 4/2003 | Stegemeier et al. | |
| 2003/0168220 | A1 | 9/2003 | Patel | |
| 2004/0089473 | A1 | 5/2004 | Kayes | |
| 2004/0163811 | A1 | 8/2004 | McKee et al. | |
| 2004/0256154 | A1 | 12/2004 | Medd et al. | |
| 2007/0272411 | A1 | 11/2007 | Lopez de Cardenas et al. | |
| 2008/0115943 | A1 * | 5/2008 | Myers et al. | 166/386 |
| 2009/0114392 | A1 | 5/2009 | Tolman et al. | |

FOREIGN PATENT DOCUMENTS

| | | | |
|---|---|---|---|
| EP | 0 298 537 | B1 | 12/1992 |
| EP | 0 517 603 | A1 | 12/1992 |
| EP | 0 653 546 | A1 | 5/1995 |
| FR | 2 827 334 | A1 | 1/2003 |
| WO | WO 00/65199 | A1 | 11/2000 |

OTHER PUBLICATIONS

York, P. et al., "Total Underbalanced Well Construction, Enabled Through Expandable Technology," OTC 17434, 2005 Offshore Technology Conference, May 2-5, 2005, pp. 1-13, Houston, TX.

European Search Report, Feb. 13, 2009, 6 pages.

* cited by examiner

SYSTEMS AND METHODS FOR REGULATING FLOW IN A WELLBORE

CROSS REFERENCE TO RELATED APPLICATIONS

This application is the National Stage of International Application No. PCT/US09/31261, filed 16 Jan. 2009, which claims the benefit of U.S. Provisional Application No. 61/067,580, filed 29 Feb. 2008, which is incorporated herein in its entirety for all purposes.

FIELD

The present disclosure relates generally to systems and methods for use in hydrocarbon wells. More particularly, the present disclosure relates to systems and methods for isolating segments or zones of one or more intervals of a wellbore.

BACKGROUND

This section is intended to introduce the reader to various aspects of art, which may be associated with embodiments of the present invention. This discussion is believed to be helpful in providing the reader with information to facilitate a better understanding of particular techniques of the present invention. Accordingly, it should be understood that these statements are to be read in this light, and not necessarily as admissions of prior art.

Conventional hydrocarbon producing wells and other wells associated with hydrocarbon production, such as injection wells, include a wellbore extending deep into the earth and a tubing extending through the wellbore to a region in which hydrocarbons are able to enter the wellbore (or fluids from the wellbore are able to enter the formation). Such wells can be configured in various manners utilizing continually advancing technologies. For example, some wells are drilled vertically while others utilize directional drilling techniques to expand the horizontal reach of the wells drilled from a single surface pad or offshore platform. Depending on the region being drilled and the nature of the geological formations being drilled, the wellbore may include cased and/or uncased (open-hole) lengths. Within a given formation being drilled, the wellbore may pass through a number of intervals having varying properties. While a single wellbore may pass through tens or hundreds of formation regions having different properties, operators are generally interested in whether a particular region is a producing interval or a non-producing interval and the lengths of the wellbore can be characterized as such. Accordingly, for the purposes of this application the term "interval" will be used to refer to lengths of the wellbore or formation which are predominantly producing or non-producing rather than to specific lengths of the formation having homogenous formation properties. For example, a producing interval may include a number of variations along the length thereof, including segments or sub-lengths that are non-producing. FIG. 1 schematically illustrates one exemplary wellbore 10 drilled into a formation 12 and having a producing interval 14. The producing interval 14 illustrated includes reservoirs 16 spaced along the length of the wellbore 18 by non-producing or less permeable regions of the formation 12.

As is well-known, wellbores are frequently drilled to great lengths and under difficult environmental conditions. Depending on the field being drilled, the wellbores may be tens of thousands of feet long with multiple producing intervals and/or with producing intervals spanning hundreds or thousands of feet. In order to facilitate wellbore operations, such as injection, production, etc., wellbores are often divided lengthwise through the use of packers, which come in a variety of configurations. FIG. 2 schematically illustrates the wellbore 18 of FIG. 1 configured with packers 20. While packers can be used in a variety of circumstances, their operation is similar regardless of the purpose for use. Conventional packers are typically coupled to other tubing members, such as production tubing members, and run into the wellbore in a first configuration smaller than the diameter of the wellbore. Once the packer is positioned within the wellbore, the packer is set, which may be effected by mechanical actuation, by hydraulics, or by other initiation paths (such as by using a swellable packer that expands when contacted by predetermined substances that can be pumped into the wellbore or allowed to enter the wellbore from the formation). When the packer is set in the wellbore, the outer diameter of the packer is designed to be larger than the inner diameter of the wellbore causing the packer to create a positive seal against the wellbore wall (whether cased or open-hole). Packers are often rated by the pressure difference across the packer that the packer can withstand without having the seal break and the intended isolation lost.

Because packers are designed and configured to create a positive seal that can withstand pressure differences across the packer without leaking, packer design and construction is generally relatively complex and expensive. Cup-type packers are among the simplest of packer configurations because they have no moving parts and are still able to provide a positive seal against pressure differences. Regardless of the packer configuration, conventional packers present several common problems. Packers, including cup-type packers, are known to be expensive tools due to the complexity of the materials and/or the parts and assemblies. Additionally, packers present additional steps and costs during installation of the packers and during removal of the packers. It is not uncommon for the positive seal created by the packer to become a substantially permanent seal over the course of time under the conditions of a common wellbore. For example, many wellbores equipped with one or more packers must be worked over to remove the tubing and packers. Accordingly, while operators have long recognized the desirability of dividing the wellbore into multiple intervals with packers, the costs and complexities associated with packers has generally limited packer use to no more than two or three packers per wellbore.

While limiting the use of packers can simplify the initial completion and reduce the initial capital investment of a wellbore, production zones including multiple reservoirs of different characteristics and/or of great length present a variety of challenges to the well's operation, at least some of which are illustrated in FIG. 1. As introduced above, the interval 14 of FIG. 1 includes several reservoirs 16 having different properties, such as differing reservoir volumes, different reservoir pressures, and different permeabilities. The schematic well 10 of FIG. 1 represents these different properties with different sizes of the reservoirs 16. Similarly, the production rate from the different reservoirs may vary in accordance with one or more of the properties of the reservoir and/or depending on the operation of the wellbore. FIG. 1 represents the differences in flow rates by the use of directional arrows, which vary in number and/or magnitude according to the exemplary flow from the exemplary reservoirs.

The well 10 of FIG. 1 is a conventional wellbore completion with or without packers. The wellbore 18 and interval 14 illustrated in FIG. 1 may be hundreds of feet long or may be several thousand feet long. The wellbore 18 is completed with a casing 22, which is perforated to allow fluid flow between the reservoir 16 in the formation 12 and the wellbore annulus 24. Fluids entering the wellbore annulus 24 flow in the annulus according to the natural forces applied thereto. The flow path preferred by operators of well's similar to FIG. 1 is for the fluid to descend to the end of the tubular 26, such as illustrated by the descending flow arrows 28, enter the tubular 26 and flow out of the wellbore, such as illustrated by tubular flow arrow 30.

FIG. 1 illustrates at least two of the problems frequently encountered with such wellbore configurations, each of which are affected by the relationship between the tubular opening 32 and the various reservoirs 16. The placement of the tubular 26, and particularly the end of the tubular providing the tubular opening 32, within the wellbore 18 is important in optimizing the production, particularly when the production interval 14 is long and/or includes multiple reservoirs 16 having different characteristics. The placement of the tubular 26 is particularly important in gas wells, as one of the key functions of the tubing in gas wells is to provide a smaller cross-sectional flow area to raise the gas velocity, allowing co-produced water to be carried to the surface. If the gas velocity is too low, the co-produced liquids will fall downward as a result of gravitational forces forming the liquid accumulation 34 shown in FIG. 1. If the tubing is set too deep in the production interval 14, the liquid accumulation 34 (i.e., water or gas condensate) can build up at the bottom of the wellbore 18 or production interval creating a resistance to gas flow entering the tubular opening 32. This liquid accumulation 34 may be sufficient to change the flow paths in the annulus or even to block the tubular opening 32.

However, for fluids to enter the tubular opening 32 there must be an adequate pressure differential from the point at which the fluid enters the annulus to the tubular opening. The fluids entering the tubular opening 32 reduces the pressure at the bottom of the producing interval 14. Reservoirs that are spaced away from the tubular entry may not experience that pressure differential. For example, the path of least resistance for fluids entering the wellbore annulus 24 from the second reservoir 36 may experience competing pressures, one following the descending flow arrows 28 and another in the direction of the ascending flow arrows 38. The ascending flow arrow 38 may result in cross-flow where the hydrocarbons re-enter the formation 12 through a different reservoir, such as the first reservoir 40. Additionally or alternatively, a reservoir 16 along the path of the descending flow arrows 28 may have a sufficiently low pressure and sufficiently high permeability to allow fluids to re-enter the formation. The cross-flow or re-entry commonly occurs at higher elevations within the wellbore where the pressure in the formation is reduced. Depending on the relative resistance to flow within the wellbore annulus and the pressure variances within the formation, the cross-flow effect can significantly diminish or eliminate production from the interval 14. This effect is most evident when completed comingled zones extend over thousands of feet vertically. If tubing strings are set too high in the wellbore, gas flow falls below a critical sweep velocity below the end of tubing and liquids accumulate in the bottom of the well. If the tubing strings are set too low in the wellbore, the resulting hydrodynamics can result in a well that is unable to flow using well pressure alone.

The above challenges and problems of comingled reservoirs could be addressed by utilizing packers to divide the wellbore into smaller zones, such as illustrated in FIG. 2. As mentioned above, the increased cost and complexity of packers typically limits their use to no more than two or three for each wellbore. FIG. 2 illustrates the use of two packers attempting to sufficiently compartmentalize the multiple reservoirs 16. FIG. 2 also illustrates that each of the producing zones 42 (created by the packers) may be provided with a sand screen 44 or other fluid entry device to allow the produced fluids into the tubular; the sand screen 44 is one of a variety of devices known and available for such uses. The configuration in FIG. 2 can be used when two or more reservoirs are separated from each other by non-producing zones but efficiencies are attempted to be gained by comingling the reservoirs in a single wellbore. In a formation where multiple reservoirs are closely spaced or where a large reservoir has varied properties along its length, the costs, risks, and complexity limit the use of packers. However, as illustrated, the producing zones 42 still comingle two reservoirs presenting the possibility of re-entry and possible liquid drop-out. Due to the cost, complexity, and risks associated with packers, increasing the number of packers to sufficiently isolate the many reservoirs that may be present in an extended length production interval is often impractical, if not impossible.

If the problems are limited to evacuating liquids from the wellbore, various other solutions have been presented, including plunger lift technologies and other artificial lift options. Plunger lift applications have had some success in evacuating liquid accumulations in a gas well, but such applications are very sensitive to pressure variations during operation. With long producing intervals having multiple reservoirs in a drawn-down condition, a 20 psi variation in the surface or tubing pressure can suspend flow until multiple, large, man-made fracture wings can fill with gas to equalize and exceed short term pressure variations. When this occurs, mist flow stops in both the tubing and annulus of the well, thus dropping out liquids and forming heavy columns of fluid weight, that must be overcome with the well's own energy or pressure. Other artificial lift options can be used to accomplish fluid removal from the well. However, these other techniques each require induced energy or horsepower to drive the mechanism such as electrical sub pumps, rod and tubing pumps, gas lift, and jet pumps. Each of these options increases the initial cost and capital investment for the well.

Accordingly, a need still exists for cost-effective technology to optimize hydrocarbon flow to the surface in production intervals of extended length and/or production intervals including multiple reservoirs.

SUMMARY

The present disclosure provides isolation systems for creating zonal isolation in a hydrocarbon wellbore. Isolation systems of the present disclosure may include a tubular segment having an opening defined therein. Additionally, a first isolation assembly is adapted to connect to a first end of the tubular segment and is adapted to block at least a portion of a wellbore annulus between the tubular segment and a wellbore wall when disposed in a wellbore. Still additionally, some implementations include a second isolation assembly adapted to connect to the second end of the tubular segment and adapted to block at least a portion the annulus between the tubular segment and the wellbore wall when disposed in the wellbore. Isolation systems of the present disclosure may include at least one isolation assembly configured as a leaky isolation assembly. A leaky isolation system is adapted to cooperate with the opening defined in the tubular segment to form an isolation zone having at least two outlets. A first outlet is provided through the opening into the tubular and a second outlet is provided past the leaky isolation assembly. The isolation system, including the tubular segment, the opening, and the leaky isolation assembly cooperate to provide an isolation zone having hydraulics during operation preferentially driving fluids through the first outlet and at least substantially preventing fluid from passing the isolation assembly.

Additionally or alternatively, isolation systems for use in a wellbore according to the present disclosure may include one or more tubular segments and at least one isolation assembly. The tubular segment defines an inner conduit and defines a wellbore annulus between the tubular segment and a wellbore wall when the tubular segment is disposed in a wellbore. The at least one isolation assembly is adapted to block at least a portion of the wellbore annulus. The at least one isolation assembly is further configured as a leaky isolation assembly to separate the wellbore annulus into at least two isolated zones when disposed in the wellbore. At least one of the tubular segments comprises an opening defined therein providing fluid communication between the wellbore annulus and the inner conduit.

Methods for using isolation systems in hydrocarbon wells are also provided. Exemplary methods include providing a tubular segment having an opening in the tubular segment providing fluid communication between an inner conduit of the tubular segment and a wellbore annulus when the tubular segment is disposed in a wellbore. The methods further include operatively associating an isolation system with the tubular segment. The isolation system is adapted to block at least a portion of the wellbore annulus. The at least one isolation system is a leaky isolation assembly. The opening is provided in operative association with the leaky isolation assembly to induce flow through the opening and to limit flow past the leaky isolation assembly.

BRIEF DESCRIPTION OF THE DRAWINGS

The foregoing and other advantages of the present technique may become apparent upon reading the following detailed description and upon reference to the drawings in which.

DETAILED DESCRIPTION

In the following detailed description, specific aspects and features of the present invention are described in connection with several embodiments. However, to the extent that the following description is specific to a particular embodiment or a particular use of the present techniques, it is intended to be illustrative only and merely provides a concise description of exemplary embodiments. Moreover, in the event that a particular aspect or feature is described in connection with a particular embodiment, such aspects and features may be found and/or implemented with other embodiments of the present invention where appropriate. Accordingly, the invention is not limited to the specific embodiments described below, but includes all alternatives, modifications, and equivalents falling within the scope of the appended claims or within the scope of such claims as may be subsequently be filed or amended.

Figure 1:
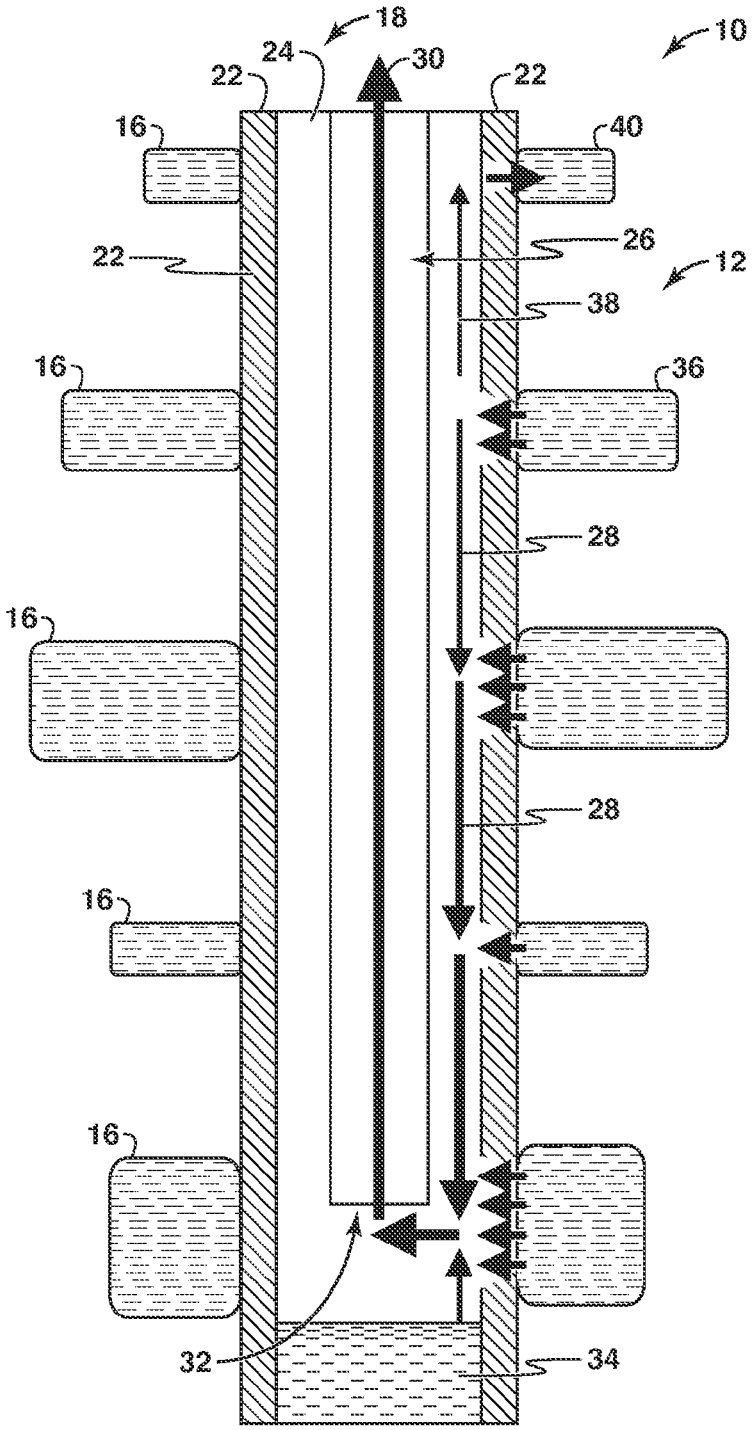
FIG. 1 (Prior Art)
FIG. 1 is a schematic illustration of a conventional wellbore including a tubular string.
Figure 2:
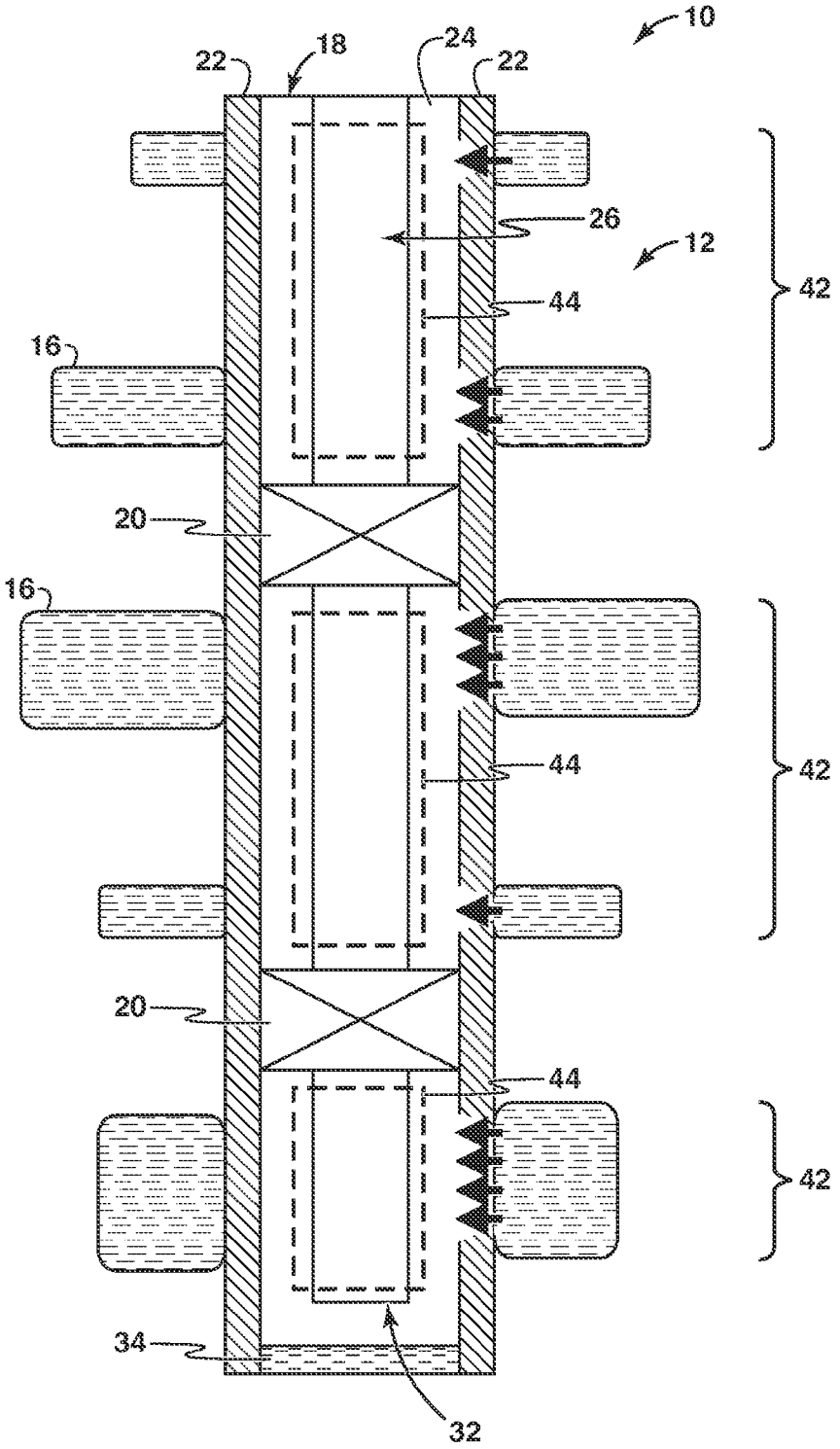
FIG. 2 (Prior Art)
FIG. 2 is a schematic illustration of a conventional wellbore showing a production interval segmented by conventional packers.
Figure 3:
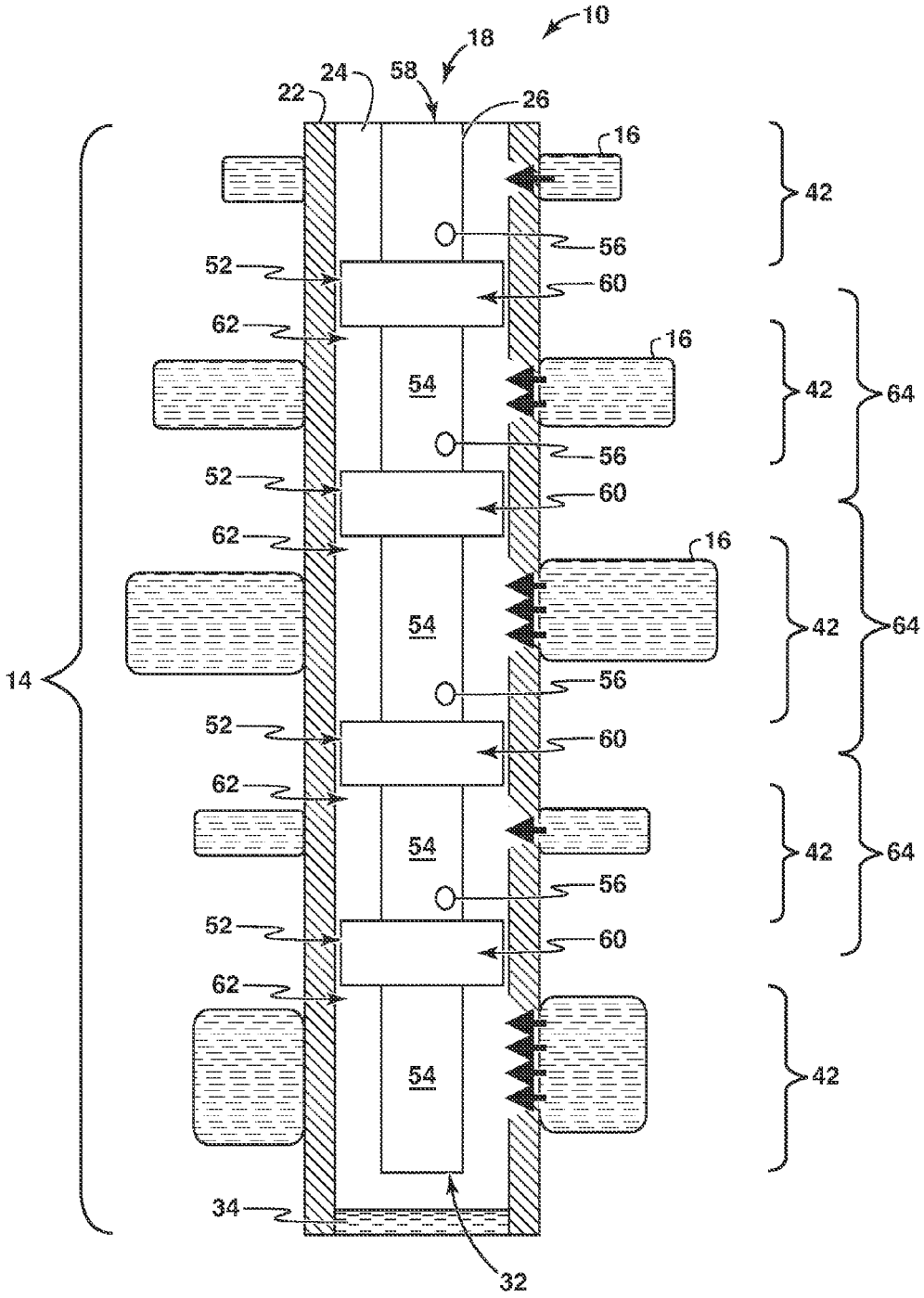
FIG. 3 is a schematic illustration of a wellbore including a tubular string provided with a plurality of isolation systems.

The present technologies recognize that fluid flow in a wellbore follows the path of least resistance and provides apparatus, systems, and methods to minimize the pressure drop between the formation and an opening in the tubular string that extends from the surface into the wellbore. FIG. 3 provides a schematic view of the present technologies deployed in a wellbore. For purposes of comparison, the well 10 of FIG. 3 includes the same formation 12, producing interval 14, reservoirs, 16, wellbore 18, and casing 22 as FIGS. 1 and 2. Similar to FIG. 2, the well 10 of FIG. 3 is divided into multiple producing zones 42. Contrary to FIG. 2, however, the producing interval 14 of FIG. 3 is successfully divided into five exemplary producing zones through the use of four isolation assemblies 52. As will be discussed to much greater length and detail herein, the isolation assemblies 52 are substantially different from the conventional packers 20 of FIG. 2 and provide solutions to the limitations imposed by the packers. It should be noted that the illustration of FIG. 3 is highly schematic and that the isolation assemblies may be more than the simple block member illustrated.

FIG. 3 illustrates the tubular string 26 extending into the wellbore 18, which may consist of a plurality of tubular joints (not shown individually), such as is conventional. The tubular 26, which may also be referred to as a tubular string when two or more joints are connected together, is divided into multiple tubular segments 54 by the isolation assemblies 52, which may include coupling features to couple adjacent tubular segments 54 together. Each of the tubular segments 54 may include one or more tubular joints as may be necessary or desired to provide the individual tubular segments 54 with the desired length in relation to the reservoir 16 locations and spacings. For example, a given tubular segment 54 may consist of a single, or multiple, conventional thirty foot tubular joint(s). Additionally or alternatively, a given tubular segment 54 may include one or more tubular joints of other lengths, as suggested by the inconsistency in the illustrated different lengths of the tubular segments 54 in FIG. 3. Moreover, in some implementations, the tubular segments 54 may include tubular joints of different configurations. For example, a particular tubular segment 54 may include several joints of plain tubular members and one or more tubular joints configured or coupled with auxiliary equipment or features.

As illustrated in FIG. 3, several of the tubular segments 54 include an opening 56 defined therein to allow fluids to pass from the wellbore annulus 24 between the tubular string 26 and the casing 22 into the inner conduit 58 of the tubular segment 54. Opening 56 is illustrated in FIG. 3 as representative of the multitude of technologies, devices, assemblies, and apparati that may be used to provide fluid communication between the wellbore annulus 24 and the inner conduit 58 of the tubular. Accordingly, for the purposes of the present application, opening 56 will be used to refer to any one or more of such technologies, devices, etc. that may be configured to provide fluid communication, which communication may be selective.

The isolation assemblies 52 and the tubular segments 54 provided with one or more openings 56 together form the basic elements of the isolation systems of the present invention. Different in operation from the packers of conventional practice, the present isolation systems effect the desired zonal isolation within the wellbore by the cooperative relationship between the isolation assembly(ies) and the opening(s), which will be better understood from the reading below and the accompanying Figures. However, by way of introduction, the isolation systems of the present invention provide at least one leaky isolation assembly 60 adapted to block at least a portion of the wellbore annulus 24. The leaky isolation assemblies 60 are adapted to cooperate with the openings 56 to form isolation zones 62 having a preferred fluid path between the reservoir and the opening 56 and an alternative fluid path past the leaky isolation assembly 60 and into the adjacent producing zone 42, which may be another isolation zone 62.

As indicated, the leaky isolation assemblies 60 of the present disclosure are configured to allow fluid to move past the leaky isolation assembly 60 and between producing zones 42. It should be understood, therefore, that the leaky isolation assemblies are different from conventional packers at least in the aspect that a positive seal between the casing, or other wellbore wall, and the tubular 26 is not required, and in some implementations is specifically avoided. By having a restriction or blockage less than a positive seal, the isolation assemblies 52 of the present invention are more easily run into the wellbore 18 and more easily removed from the wellbore. Additionally, because a positive seal is not required for successful creation of isolation zones 62, the isolation systems of the present disclosure are more tolerant to partial failure of the leaky isolation assemblies.

Accordingly, leaky isolation assemblies 60 within the scope of the present disclosure are adapted to form isolation zones 62 within the wellbore. The isolation zone 62 receives the fluids from the reservoir(s) 16 into the wellbore annulus. From the annulus, the fluids generally have two outlets available when in an isolation zone formed with at least one leaky isolation assembly. For one, the fluids may enter the inner conduit of the tubular segment through the opening 56. As an alternative, the fluids may flow past the leaky isolation assembly into the adjacent production zone. The isolation systems of the present disclosure accomplish the desired zonal isolation by configuring the tubular string to create preferred hydraulic conditions to promote flow through the first outlet (i.e., through the opening 56 and into the tubular) rather than through the second outlet (i.e., past the leaky isolation assembly). In some implementations, the tubular segments 54, the placement of the isolation assemblies 52, and the position of the opening 56 may be selected and/or configured to minimize the pressure drop between the formation face (i.e., the perforation or other interface between the formation and the wellbore annulus) and the opening 56 to the inner conduit while maximizing the pressure difference across the leaky isolation assemblies during operation of the well.

Among the advantages of the present technologies is the ability of the isolation systems to be operational (i.e., not in a failed state) even when the isolation between zones is not complete, such as when flow is possible past the leaky isolation assemblies. The use of such leak-tolerant isolation assemblies increases the life-span and broadens the operating conditions under which the present technologies may be utilized. In some implementations, it may be found that the regular cycling of the well during the life of the well may cause the leaky isolation assemblies to have a dynamic configuration while downhole. For example, varied temperatures and pressures may cause expansion and/or contraction of the leaky isolation assembly materials. Additionally or alternatively, materials or debris in the wellbore may associate with the leaky isolation assemblies. For these reasons or others it may found that a particular leaky isolation assembly temporarily forms a positive seal in the annulus. Regardless of the strength of the seal or barrier that may be formed by the leaky isolation assemblies during operation, the isolation zones of the present disclosure maintain their operational integrity over time under the changing downhole conditions due to the tolerance to a failed seal (or a leaky blockage), which is not a failure condition when combined with the openings 56 in the tubular segments 54 as provided herein.

As introduced above, the isolation systems of the present disclosure operate to form isolation zones 62 through the cooperative relationship between the leaky isolation assembly 60 and the opening 56. The opening 56 is disposed in the tubular segment 54 in operative relationship with the reservoir(s) 16 within the isolation zone to optimize the pressure drop from the reservoir, or more properly from the interface of the reservoir with the wellbore wall, to the opening 56 in the tubular. Accordingly, in some implementations, more than one opening 56 may be provided in a single isolation zone, such as spaced circumferentially around the tubular segment or spaced vertically along the tubular segment. Similarly, where the opening 56 is configured with one or more technologies or devices, such as sand control technologies or variable or controllable opening sizes, the configuration and/or operation of these devices may be selected to optimize the pressure drop from the reservoir 16 to the opening 56 or to otherwise configure the isolation zone 62 according to operating preferences. As one example, two or more openings may be spaced vertically along the tubular segment 54 with all but one of the openings being closed at a given time. As conditions in the isolation zone change over time, different openings may be opened and/or closed to optimize the production of the particular isolation zone.

In some implementations it may be preferred to minimize the pressure drop from the reservoir 16 to the opening 56 to thereby maximize the fluid velocity entering the tubular segment 54 and/or the fluid velocity within the inner conduit of the tubular segment. In other implementations, it may be preferred to optimize the pressure drop by maintaining the pressure differential between the reservoir 16 and the opening 56 greater than the pressure differential between adjacent isolation zones 62 across the leaky isolation assembly 60. Stated otherwise, the leaky isolation assembly 60 and the opening 56 effectively create an isolation zone 62 by maintaining the reservoir/tubular pressure differential greater than the zone-to-zone pressure differential. While the leaky isolation assembly 60 does not need to create a positive seal between the isolation zones, the effective seal between the zones created by the relative pressure differentials and the preferred flow paths is sufficient to limit, if not completely prevent, flow between isolation zones during typical wellbore operations, such as production operations and/or injection operations.

While the reservoir/tubular pressure differential may be optimized solely based on the pressure differences between adjacent isolation zones, some implementations may consider other factors. For example, it may be preferred to optimize the flow velocity into the tubular segment, such as to improve the fluid's ability to sweep liquids from the isolation zone into the inner conduit. Additionally, it may be preferred to optimize the flow velocity to carry liquids to the surface. In gas producing wells, for example, it is not uncommon for liquids to be produced along with the desired gas. The liquids can be carried along with the gases to the surface if the flow velocity of the fluids is great enough. If the velocity passing through the opening is sufficiently high, for example, the gases will be able to sweep accumulated and/or suspended liquids into the inner conduit. Similarly, if the fluid velocity within the inner conduit of a given tubular segment is sufficiently high the liquids will be lifted along with the gases to the surface. The minimum flow velocity to move liquids from the annulus into the inner conduit may be referred to as the critical sweep velocity; the minimum velocity within the inner conduit to lift liquids along with the gas may be referred to as the critical lifting velocity. In some implementations, it may be preferred to maintain the flow velocities above both of these critical velocities to minimize the accumulation of liquids in the isolation zone and to minimize the drop out of liquids within the inner conduit. As conditions in each isolation zone may vary in temperature and pressure along the length of the wellbore, the critical sweep velocity and the critical lifting velocity may vary depending on the pressures and temperatures of the zone and/or the production capacity of the zones, etc. Additionally or alternatively, the composition of the produced fluids may vary along the length of the wellbore, which may affect the critical sweep velocity.

As illustrated in FIG. 3, each of the openings 56 is disposed vertically below the perforations providing fluid communication between the wellbore 18 and the reservoirs 16. In some implementations, such a disposition of the openings may reduce the debris and other particulate matter that is allowed to settle on the isolation assembly 52, such as by encouraging the particulate matter to be swept into the opening and carried up the tubular. By limiting the particulate matter that settles on the isolation assembly 52, removal of the isolation assemblies may be facilitated. Additionally or alternatively, the disposition of the openings at the lower end of the isolation zones may reduce the accumulation of liquids in the isolation zone, which may maintain a greater proportion of the perforations in the zone exposed for production operations.

Some implementations of the present technology may include one or more segmentation units 64 coupled to a tubing string. A segmentation unit comprises at least one tubular segment 54, or tubing joints, and at least two isolation assemblies 52. The two isolation assemblies separated by a length of tubing forms the segmentation unit 64 that may be disposed in a wellbore 18 in association with an interval 14 to segment the interval into isolation zones 62, such as described above. In some implementations, a single segmentation unit may be utilized. In other implementations, multiple segmentation units may be coupled together, either end to end as illustrated in FIG. 3 or spaced apart by sections of tubing string that are not involved in forming an isolation zone 62, such as tubing joints that may be disposed along a length of non-producing formation or along a length of the formation from which production is not desired (such as because it is producing water or other undesired composition). When multiple segmentation units 64 are disposed end to end along the tubing string, a single isolation assembly 52 may form part of two segmentation units as illustrated in FIG. 3. While the isolation systems of the present disclosure may utilize two or more isolation assemblies 52 to form the isolation zones 62 discussed herein, a single leaky isolation assembly 52 in cooperation with an opening in a tubular segment may similarly form an isolation zone when combined with other wellbore features and/or equipment. Utilization of multiple isolation assemblies 52 for elongate producing intervals may reveal the advantages of the present technology more clearly but a single instance of an isolation zone and isolation system according to present disclosure may be advantageous in certain wellbores.

Figure 4:
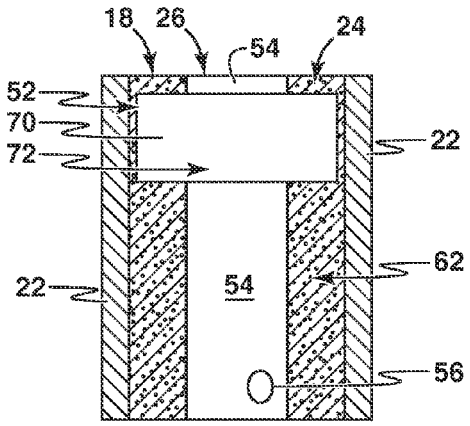
FIG. 4 is a schematic illustration of a portion of a wellbore showing an implementation of an isolation assembly.

With continuing reference to FIG. 3 and with reference to FIG. 4, additional aspects of the various isolation assemblies within the present disclosure are illustrated. FIG. 4 is a similarly schematic view of a single isolation assembly coupled to two tubular segments, one of which has an opening defined therein. As described above, some implementations of the present technology may include a single isolation assembly 52 as illustrated here; in other implementations, multiple isolation assemblies 52 may be incorporated into a tubing string. When multiple isolation assemblies 52 are used, each of the isolation assemblies may be of a common construction and/or configuration or may be different from each other.

FIG. 4 schematically illustrates a simple isolation assembly construction configured as a leaky isolation assembly that is selected to have an outer diameter that approaches the inner diameter of the wellbore, such as the wellbore wall defined by a casing. In some implementations, the leaky isolation assembly may have an outer diameter selected based on the drift diameter of the wellbore. For example, the outer diameter of the leaky isolation assembly may be between about 90% and about 110% of the drift diameter of the wellbore. In other implementations, the inner diameter of the wellbore at the location where the leaky isolation assembly will be disposed may be known and the outer diameter may be selected based on the known or estimated inner diameter of the wellbore at that location.

Continuing with FIG. 4, the leaky isolation assembly 60 may comprise a collar 70 adapted to couple two opposing tubular segments 54 and to block at least a portion of the wellbore annulus 24. Collar 70 is one example of a suitable restriction member that may be incorporated into leaky isolation assemblies according to the present disclosure. Tubular joints conventionally used to form tubular strings 26 are available in a plurality of lengths and are typically coupled together by collars. Due to the variety of diameters of tubing that is run in the wellbore for the different operations, collars are available in a variety of configurations, including varied inner diameters, outer diameters, and wall thickness. Conventional tubing strings are assembled by joining two adjacent tubing joints with a collar selected to have an inner diameter (s) corresponding to the respective tubing joints and to have a wall thickness as small as possible while maintaining the integrity of the tubular string. The wall thickness was minimized in order to facilitate the tripping of the tubular string (in and/or out) and to minimize the costs of the collar.

As illustrated in FIG. 4, the collar 70 selected to connect two adjacent tubing joints may be selected to have inner diameter(s) corresponding to the tubular joints and to have an outer diameter selected to approximate the inner diameter of the wellbore. As discussed above, the outer diameter of the collar 70 may be selected to block at least a portion of the wellbore annulus 24. To accomplish the desired degree of blockage, the collar 70 may be configured with a greater wall thickness than may otherwise be required to maintain the integrity of the tubular string. More specifically, the collar wall thickness may be selected to bring the outer diameter of the collar 70 to greater than about 90% of the inner diameter of the wellbore. Additionally or alternatively, to facilitate running the tubular string and collar into the wellbore, the collar may be selected to be less than about 110% of the drift diameter of the wellbore. Collars 70 suitable to function as leaky isolation assemblies 60 of the isolation assemblies 52 may be selected from commercially available collars or may be custom made for particular applications.

As described above, a perfect seal is not required between the collar 70 and the wellbore wall. Accordingly, commercially available collars may provide sufficient blockage or restriction to create an isolation zone together with suitable openings 56. It should be recognized that the collars 70 described herein as suitable as a leaky isolation assemblies 60 may be made of any suitable materials for use under the conditions of the wellbore, such as the conventional materials used for collars and other tubular string components.

Figure 5:
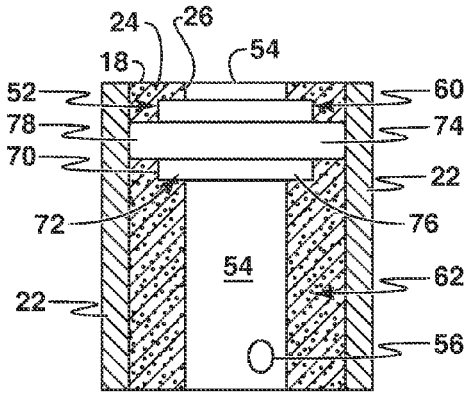
FIG. 5 is schematic illustration similar to FIG. 5 showing another implementation of an isolation assembly.

FIG. 5 illustrates additional aspects of the present technology. Similar to FIG. 4, FIG. 5 illustrates a single isolation assembly 52 disposed in a wellbore 18 in association with an opening 56 to form an isolation zone 62 below the isolation assembly 52. The isolation assembly 52 of FIG. 5 comprises a restriction member 72 adapted to block at least a portion of the wellbore annulus by having an outer diameter between about 90% and about 110% of the wellbore drift diameter. FIG. 5 illustrates that the restriction member 72 may be a single element, such as collar 70 of FIG. 4, or may be an assembly of elements as in FIG. 5. The restriction member 72 of FIG. 5 includes a collar 70 and a restriction disk 74 circumscribing the collar. Moreover, the collar 70 may be adapted with a groove or other structural feature to retain the restriction disk 74 in the desired orientation.

As one example of a suitable restriction disk 74, a flexible member such as an elastomeric disk may be disposed around a collar or other body member 76. The body member 76 may be conventional collar or customized collar, such as an oversized collar described above or a collar having retention features. The restriction disk 74 may be constructed of any suitable material tolerant to the conditions (heat, pressure, etc.) of the wellbore. Exemplary materials suitable for the conditions of the wellbore may be identified from existing technologies known to those familiar with the industry. While a suitably sized collar 70, with or without a restriction disk 74, may provide an isolation assembly 52 within the scope of the present invention, it should be noted that isolation assemblies may be implemented in the middle of a tubing joint without the use of collars or other coupling features. For example, body member 76 may be adapted to be positioned anywhere along the length of a tubing joint.

Similarly, the restriction disk 74 may be constructed according to any suitable configuration. For example, the restriction disk 74 may be configured to have an outer diameter sufficient to block the wellbore annulus as discussed above. Additionally, the restriction disk 74 may have a deformable configuration adapted to facilitate the tripping of the isolation assembly and/or to provide a leaky isolation assembly 60. For example, because the restriction disk 74 is deformable it may provide a tighter tolerance or tighter fit against the wellbore wall and/or the tubular while still not providing a positive seal. Because a positive seal is not required or formed, the material selection and restriction member construction may be less complex and the risks of insertion and removal can be minimized. For example, the risks associated with removal of cup-type packers can be reduced, if not eliminated, by avoiding the creation of a positive seal. As discussed above, the deformable characteristic of the restriction disk(s) 74 may lead to the creation of a nominal positive seal under some operating conditions. However, the design and construction of the isolation assemblies 60 are not directed towards ensuring a positive seal and/or maintenance of a positive seal under particular operating conditions or for particular periods of time.

The restriction disk 74 may be configured to deform at predetermined pressures. Such deformation may be desirable when the wellbore annulus pressure exceeds some threshold to allow fluid flow between isolation zones. Additionally or alternatively, the restriction disk may be adapted or configured to deform when pressure is applied to the disk while running the isolation assembly 52 into the wellbore or when trying to remove the isolation assembly from the wellbore. In either circumstance, the restriction disk may be configured to deform in either or any direction so as to allow fluid flow in either direction and/or to allow the isolation element to be moved in either direction relative to the wellbore wall. For example, a symmetrical configuration may enable bi-directional leakage or deformation. A deformable restriction disk 74 may also be desirable to enable the restriction member 72 to be run past debris, sand, particles, or other irregularities that may be on the wellbore wall without damaging the restriction disk.

Similarly, the restriction disk 74 and/or the materials thereof may be configured and/or selected to deform with temperature. For example, the restriction disk 74 may expand with increasing temperature so as to reduce the tolerance or space between the restriction disk 74 and the casing/wellbore wall 22 as the restriction disk is positioned within the well. In exemplary configurations, the restriction disk may be between about 75 percent and about 90 percent of the drift diameter at the surface and may expand to between about 90 percent and about 110 percent at the desired position in the well. Temperature reactive restriction disks 74 may contract upon exposure to cold temperatures, such as when cold water is pumped into the well, to facilitate removal of the isolation assembly 52.

In some implementations, the restriction member 72 may be provided by a pigging disk 78 or another disk configured to allow the isolation assembly to be pigged into the wellbore. While pigs have been used for many years in pipeline applications, they are not known to have been used in wellbore applications. Without being bound by theory, it is presently believed that the harsh and relatively more uncontrolled conditions of a wellbore vis-à-vis a pipeline has heretofore prevented pigs from being used in wellbores. For example, the heat and pressures of the wellbore may undesirably affect the conventional pig. However, by selecting suitable materials of construction and restriction disk configurations, isolation assemblies including restriction disks have been effectively pigged into a wellbore when the restriction disk had outer diameters greater than the drift diameter of the wellbore. While a variety of materials and configurations may be suitable, it has been observed that a sufficiently thick restriction disk supported on either side prevents excessive or undesired extrusion of the disk, such as roll-overs, resulting in misplacement of the restriction disk in the wellbore. Other arrangements, such as using multiple restriction disks adjacent to each other have also been observed to enable the restriction disks to be more tolerant of the wellbore conditions. Bi-directional pigs (such as those that are symmetrical in the direction of the pipe) may be preferred in some implementations for their ability to be moved in both directions with equal ease, such as during placement and retrieval operations, during positioning of the isolation assembly, and/or during production and/or shut-in operations where expansion of the tubing due to temperature changes may cause upward or downward forces on the restriction disk.

In some implementations, including configurations such as those shown in the accompany drawings, the isolation assembly 52 may be run into the whole under particular conditions to facilitate the movement with the wellbore and/or the positioning within the wellbore. As indicated above, temperature and pressure are two such conditions that may be controlled. Similarly, the fluids run in the wellbore before and/or during the installation of the isolation assembly 52 may affect the ease with which the isolation assembly can installed. For example, lubricants can be used to facilitate the installation of the isolation assembly within the wellbore. A variety of lubricants are commonly used in the industry and suitable lubricants may depend on the materials selected for the isolation assembly and the environment of the well, among other factors identifiable by those of skill in the art.

While not illustrated in the Figures, the isolation assemblies 52 may also be provided with auxiliary or cooperating features, whether the isolation assembly 52 includes a restriction disk 74, as in FIG. 5, or not, as in FIG. 4. For example, it may be preferred to incorporate one or more centralizers and/or deflectors to help guide the isolation assembly through the wellbore during insertion and/or removal. For example, in deviated wells it may be preferred to deflect the main body of the isolation assembly from the wellbore walls as the isolation assembly trips through the deviations. As another non-limiting example, one or more elements of the restriction assembly 52 may be provided with a wiper (not shown) extending away from the main body of the element. For example, a flexible wiper disposed on the outer surface of a collar 70 may function to clean debris away from the wellbore wall and may assist in provide a desired degree of flow resistance past the isolation assembly while avoiding the creation of a positive seal that would complicate the tripping of the isolation assembly.

Additionally or alternatively, the isolation assemblies may be adapted to include a flow meter, such as between restriction members or built into the body member. For example, a thin metal ring may be disposed within or adjacent to the isolation assembly to produce an acoustic or other signal as fluid flows past the isolation assembly. As described above, the leaky isolation assemblies of the present disclosure are configured to allow a flow path past the isolation assembly and between isolation zones. However, the preferred and primary flow path is intended to be directed into the tubular via the opening 56. Accordingly, in some implementations, it may be preferred to monitor the flow rate in this less preferred path. In some implementations, one or more elements of the tubular string may be configurable while downhole allowing the flow to be controlled in response to measured flow between isolation zones without removing the entire tubular string from the wellbore. For example, one or more of the openings 56 may be selectively closeable according to a variety of existing or still to be developed technology to alter the flow patterns within the wellbore.

Still further, isolation assemblies within the scope of the present disclosure may be provided with one or more passageways through the restriction member 72 such that the possibility of a positive seal being formed is further reduced. As one example, when the restriction member 72 is provided by an intentionally oversized collar 70, the collar may be machined to provide open tubes through the collar material to provide fluid communication between the isolation zones on either side of the restriction member 70. Similarly, when the restriction member 72 includes an elastomeric material, the elastomeric material may be formed to include passages therethrough. In some implementations, support tubes may be disposed in passages formed through the elastomeric material so as to promote maintenance of the open passageway even during varied downhole conditions. Additionally or alternatively, some implementations may include passageways for passage of a tubing from surface through the isolation assembly(ies) to one or more annuli below a restriction disk. For example, it may be desired to run one or more fluids, such as soaps, lubricants, corrosion inhibitors, scale inhibitors, etc. into the annulus below one or more restriction disks.

Figure 6:
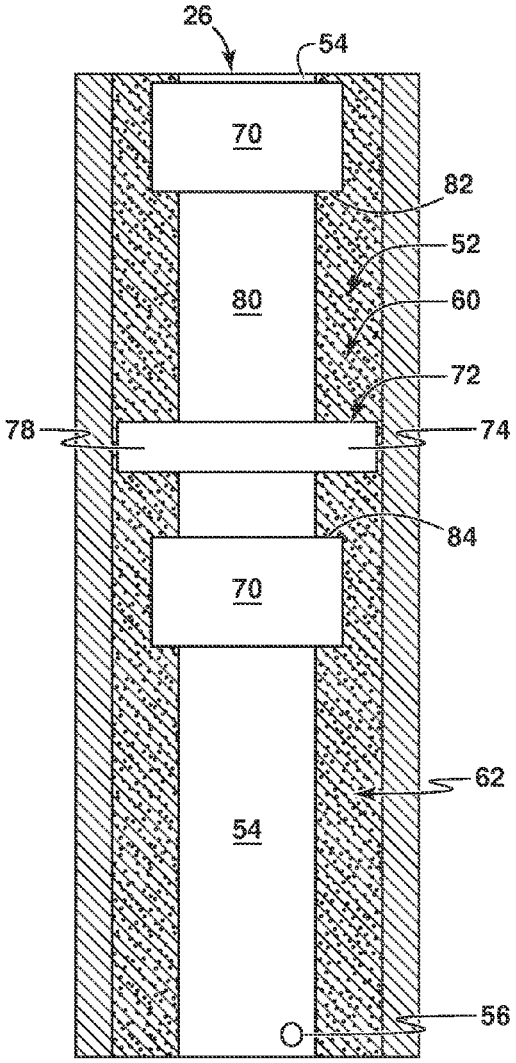
FIG. 6 is a schematic illustration of an isolation assembly disposed in wellbore.

Turning now to FIG. 6, additional features of the present isolation assemblies are schematically illustrated. FIG. 6 illustrates an isolation assembly 52 including a coupling tubular 80 and at least one restriction member 72. As discussed in connection with FIGS. 3-5, the isolation assembly 52 is adapted to couple two tubing segments 54 and therefore can be referred to as a coupling system as well as an isolation system. The coupling tubular 80 may be configured in any suitable manner to enable it to couple to adjacent tubing segments and may include a conventional tubing joint. The restriction member 72 of FIG. 6 is illustrated schematically and may be configured similar to the restriction members described in connection with FIGS. 3-5. Additionally, the use of a coupling tubular 80 together with a restriction member 72 allows a greater range of configuration options. For example, the coupling tubular 80 may be configured differently than conventional tubular joints, such as having a larger outer diameter to restrict flow in the wellbore annulus.

Additionally or alternatively, the restriction member 72 may be adapted to coordinate with the coupling tubular to provide a leaky isolation assembly. For example, the restriction member 72 may circumscribe the coupling tubular providing the leaky seal discussed above. Additionally, the relatively loose fit of the restriction member on the coupling tubular 80 may allow the restriction member to slide along the length of the coupling tubular. As illustrated in FIG. 6, the restriction member 72 is disposed on the coupling tubular 80 between a first stop 82 and a second stop 84. The stops 82, 84 may be provided by collars 70, such as conventional collars used to join the coupling tubular to the adjacent tubular segment, or through other features on the coupling tubular 80. The stops 82, 84, whether provided by collars or otherwise may be configured to restrict the sliding movement of the restriction member 72.

The sliding movement of the restriction member 72 between the two stops 82,84 may create a slide-hammer effect. As described above, the restriction element may be selected or sized to have an outer diameter between about 90% and about 110% of the drift diameter of the wellbore. With such tolerances between the restriction element 72 and the wellbore wall, it is possible for the restriction element to become stuck in the wellbore. For example, the wellbore walls are often unpredictable or the wellbore annulus may include debris or other material that can become wedged between the restriction member 72 and the wellbore wall impeding the movement of the restriction member within the wellbore annulus. Additionally or alternatively, it is not unusual for particulate matter to accumulate during production operations resulting in an accumulation of material on top of packers, which in the implementation of the present technology would place accumulation of particulate material on top of a restriction member. Still additionally, the elastomeric material that may be incorporated into a restriction member or isolation assembly may vulcanize or otherwise lose its ability to deform or extrude around obstructions. For these or other reasons, the restriction member 72 may become stuck, even though a positive seal was specifically avoided.

The sliding relationship between the restriction member 72 and the coupling tubular 80 will allow the tubing string to move relative to the restriction member. Such movement will provide the stop 82,84 (fixedly coupled to the coupling tubular 80) with momentum allowing it to apply an impact force on the stuck restriction member 72. Depending on the configuration of the restriction member and the degree of resistance to its movement during typical operations, the spacing between the stops may vary. For example, the stops may be separated by about six inches if the expected resistance is minimal (and the size of the restriction member is sufficiently small). Other separations may be suitable to impart still greater force to the stops. For example, the coupling tubular may have a length between one foot and thirty feet with the stops provided by the collars allowing movement of the restriction member 72 along the entire length of the coupling tubular. Additionally or alternatively, the movement of the tubular segment may be varied rather than varying the sliding distance. For example, the equipment used to insert or remove the tubular string may be adapted to apply greater force on the slide hammer action or to apply an oscillating movement.

The sliding relationship between the restriction member 72 and the coupling tubular 80 may also be adapted to allow the tubular string 26 to expand and contract under varied wellbore operating conditions without buckling or applying undo forces on the downhole equipment. For example, the materials of the tubular string 26, despite many efforts, are still susceptible to expansion and contraction when the well cycles between production, injection, shut-in, and other operating conditions as the temperatures and pressures vary. It is believed that a point on the tubular string may travel between about six inches and about 40 feet depending on where that particular point is located in the wellbore. For example, the tubular string disposed very deep in the wellbore may experience greater travel than the same tubular string nearer to the surface. While some packers have been configured to allow the tubing string to move relative to the packer while downhole, such configurations are typically complex or require particular materials and/or operating conditions. The isolation assembly 52 of FIG. 6, however, allows the coupling tubular 80 to move in either direction relative to the restriction member 72 and may be configured to allow as much travel distance as may be believed to be necessary.

Figure 7:
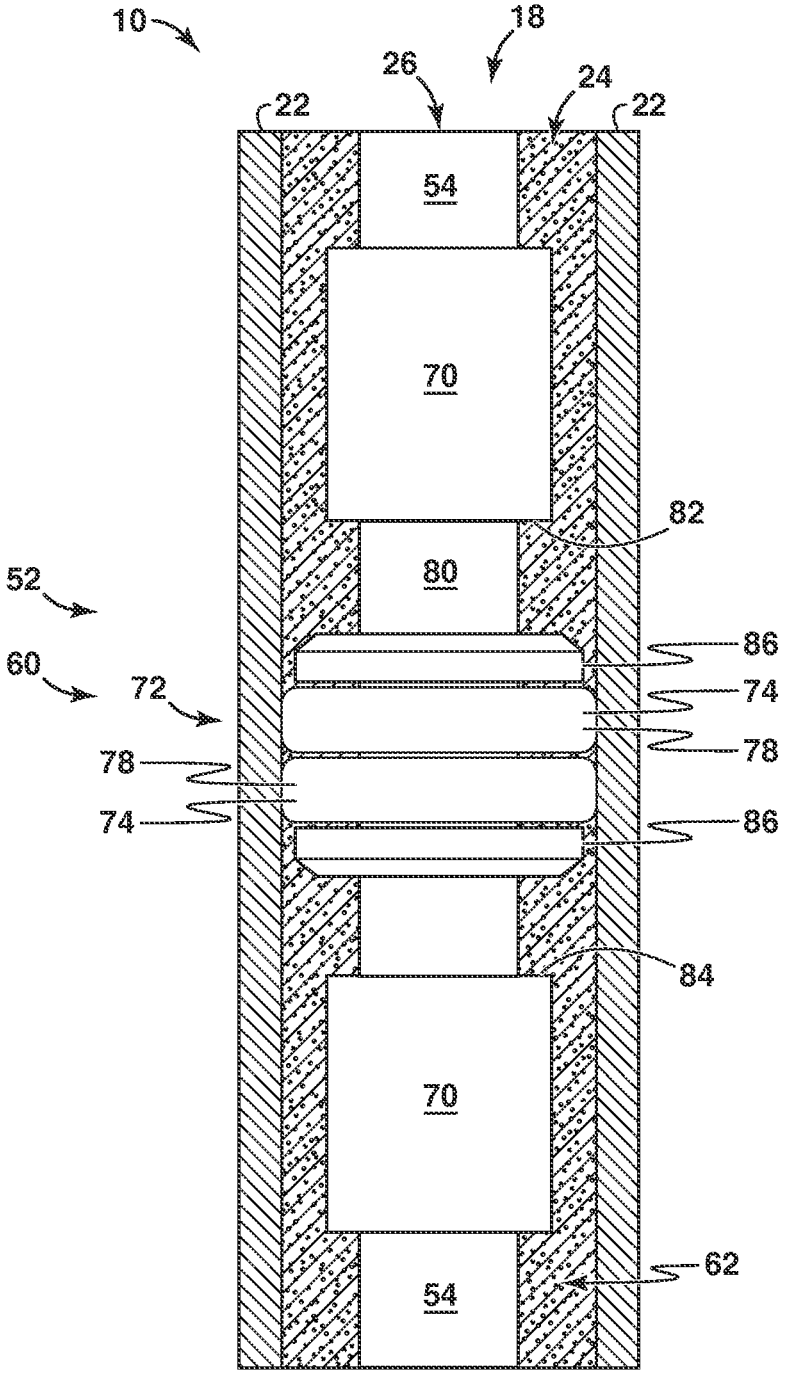
FIG. 7 is a schematic illustration of an isolation assembly disposed in a wellbore.

FIG. 7 provides another schematic illustration of an isolation assembly 52 coupled to adjacent tubular segments 54. While the illustration of FIG. 7 is in the context of a sliding restriction member 72, the configuration of the restriction member may be applied to the static restriction members of FIGS. 4 and 5. As introduced above, the restriction member 72 may be provided by a combination of elements, including a restriction disk 74 and one or more support disks 86. Two restriction disks 74 are illustrated as circumscribing the coupling tubular for movement along the length thereof while providing some degree of seal against the tubular. Any number of restriction disks 74 may be used depending on the degree of effective isolation desired between the isolation zones. In some implementations it may be preferred to use two smaller thickness restriction disks 74 rather than a thicker restriction disk. As discussed above, the restriction disks 74 are deformable to a greater or lesser degree and the thickness of the restriction disks affects the ability of the restriction disks to deform. If the restriction disk is too thick it may not be able to extrude around obstacles in the path while running the isolation assembly into or out of the wellbore and/or may form a positive seal further complicating the removal of the restriction disk. However, if the restriction disk 74 is too narrow, it may roll-over or deform under the wrong stress conditions. Without being bound by theory, it is presently believed that restriction disks having a thickness of about one inch are suitably deformable for the purposes of the present technology. It should be understood that the selected restriction disk thickness may vary depending on the selected internal and external diameters of the restriction disk. If the restriction disk is selected to fit closely against the wellbore wall and/or the coupling tubular, a thinner restriction disk may be preferred to encourage deformation under applied pressures.

FIG. 7 further illustrates that the restriction member 72 may include one or more support disks 86. The support disks 86 may be configured to help prevent roll-over of the restriction disks 74. Additionally or alternatively, the support disks 86 may be configured to provide a centralizing or guiding function to the restriction member 72 as the isolation assembly 52 is moved within the wellbore. Still additionally or alternatively, the support disks 86 may be configured to provide a flow monitoring or signaling device as described above. In some implementations, the support disks 86 may be adapted to withstand the forces that may be applied thereon when the slide-hammer functionality of the sliding restriction member 72 is utilized. For example, it may be made of materials, configurations, or of constructions suitable to withstand the forces that may be applied by the stops 82,84. Additionally or alternatively, the support disks 86 may be provided with wipers (not shown) such as described above. Wipers disposed on the support disks 86 may clear material from the wellbore before it contacts the restriction disks 74 or act as a trap to prevent debris or particles within an isolation zone from settling onto the restriction disks 74. Such particulate control may reduce the possibility of the isolation assembly 52 becoming stuck in the wellbore and/or forming a stronger seal than desired or intended. In some implementations, the components of the restriction member 72, such as the restriction disks 74 and/or the support disks 86, may be constructed of materials that are easy to mill. Additionally or alternatively, some implementations may include support disks 86 configured to break apart upon impact with the stops such that the restriction disks are more deformable and better able to pass obstructions during a retrieval operation.

Figure 8:
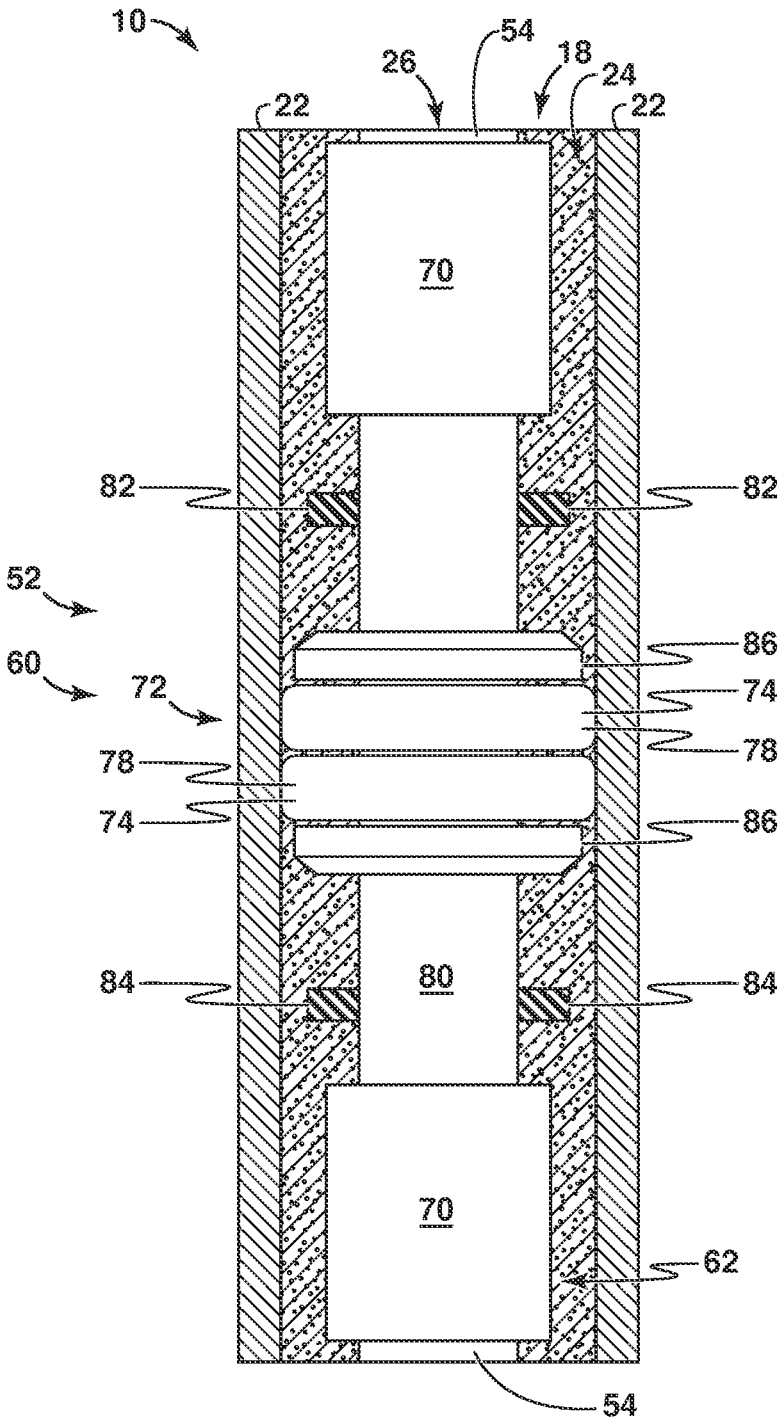
FIG. 8 is a schematic illustration of an isolation assembly having a slidable restriction member disposed in a wellbore.

FIG. 8 provides yet another schematic illustration of the isolation assembly 52 similar to that illustrated in FIG. 7. As discussed above, isolation assemblies 52 according to the present disclosure may include a coupling tubular 80 and a restriction member 72, such as shown in FIG. 8. The coupling tubular is adapted to couple to adjacent tubular segments 54. In the exemplary illustration of FIG. 8, the coupling tubular is coupled to adjacent segments by way of a conventional collar 70. The restriction member 72 is slidably disposed on the coupling tubular 80 as discussed above in connection with FIG. 7 and is disposed between two stop 82, 84. It should be noted that FIG. 8 illustrates the stops 82,84 as being provided by structure other than the collars that join the coupling tubular to the adjacent tubular segments 54. The stops 82,84 may be disks, flanges, outcroppings, enlarged or swollen portions of the coupling tubular, or any other element adapted to be associated with the coupling tubular and to limit the sliding movement of the restriction member 72. For example, a disk may be welded or otherwise adhered to a conventional tubular joint. Additionally or alternatively, the coupling tubular 80 may be provided with an enlarged region or a flange that is provided with the coupling tubular at the time of manufacture. The possibility of utilizing a disk that can be welded or otherwise fixed to the tubular joint may allow any tubing member to be suitably used as a coupling tubular 80 allowing the restriction member 72 some range of motion for the slide-hammer effect but limiting that range of motion to keep the restriction member in a desired region of the producing interval.

Figure 9:
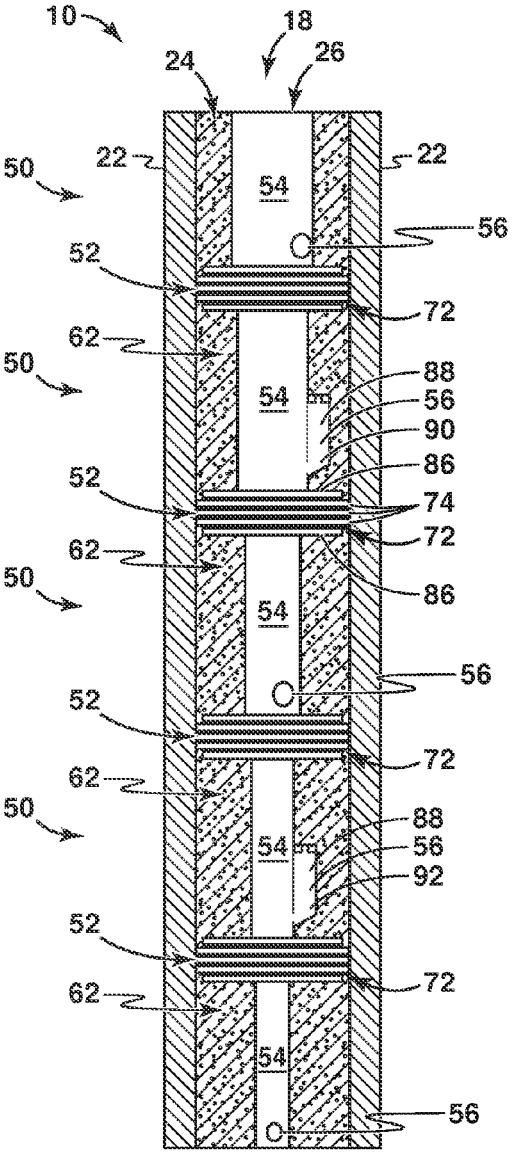
FIG. 9 is a schematic illustration of a series of isolation assemblies in cooperation with tubular segments to form a plurality of isolation systems in a wellbore.

FIG. 9 illustrates a plurality of isolation assemblies 52 and openings 56 cooperating to form a plurality of isolation systems and a plurality of isolation zones. In the schematic illustration of FIG. 9, the isolation assemblies 52 are each illustrated as a restriction member 72 comprising two restriction disks 74. The restriction disks 74 may circumscribe a body member (not shown) as described in connection with FIG. 5 or may disposed between support disks 86, which may be configured in one or more of the manners described in connection with FIGS. 7 and 8. Additionally, while FIG. 9 illustrates the isolation assemblies 52 as including a static (i.e., non-sliding) restriction member 72, a sliding configuration following the principles described in connection with FIGS. 6-8 may be employed in the implementation of FIG. 9.

Similar to FIG. 3, the implementation illustrated in FIG. 9 shows multiple isolation zones 62 formed by a plurality of isolation assemblies 52 cooperating with tubular segments 54 to form a plurality of segmentation units 64. While not explicitly illustrated in FIG. 9, it should be understood that the tubular 26 of FIG. 9 includes a plurality of tubular joints connected by collars or other coupling equipment and that each tubular segment 54 may include one or more tubular joints. Moreover, it should be understood with the assistance of the above disclosure that any one or more of the isolation assemblies 52 may be adapted to couple two tubular joints together.

With continuing reference to FIG. 9, it can be seen that each of the isolation systems 50 includes an opening 56 in the tubular segment 54. As introduced above, the opening 56 may be configured in any suitable manner to allow fluid communication between the wellbore annulus and the inner conduit of the tubular segment. Several of the openings 56 are illustrated as open holes in the sidewall of the tubular segment 54 while others are schematically illustrated as a flow regulator 88. It should be appreciated that any suitable apparatus or tool that has heretofore been used to allow and/or regulate fluid flow between an annulus and a tubular's inner conduit may be used as part of the opening 56. For example, conventional mandrels, orifices, nozzles, valves, etc. may be used. As further examples, perforated tubing may be used with or without sand control technology. In some implementations, the openings 56 may include technology that allows modification of the opening's configuration while the isolation system 50 is down hole. For example, calibrated orifice technology, sliding sleeve technology, and/or actuated valve technology may be implemented. In still other implementations, one or more of the openings 56 are formed or defined while the isolation system 50 is disposed downhole, such as through the use of perforating equipment or other wireline tools.

Continuing the discussion of FIG. 9, the schematic illustration of the tubular 26 represents the successive tubular segments 54 as having different outer diameters, with the diameters getting larger as the flow proceeds up the tubular 26. Tubing strings 26 are generally designed with two sometimes conflicting technical objectives: 1) increasing the flow velocity to maintain/exceed the critical lifting velocity (suggesting a small tubing cross-sectional area) and 2) minimizing the frictional losses (suggesting a large tubing cross-sectional area). In a conventional tubular string 26, the design of the tubular string is complicated by the expansion of gases as the hydrostatic pressure is decreased as the fluid flows upward through the tubular. Efforts have been made to provide a changing diameter tubular string to accommodate the changing frictional forces as the gases are subject to lower hydrostatic forces.

In implementations according to the present disclosure, a tubular string 26 may be provided with multiple isolation systems 50 along the length thereof providing multiple openings 56 for produced fluids to enter the tubular string. Accordingly, the mass flow rate may vary along the length of tubular strings 26 incorporating the present technology. Some implementations of the present technology, therefore may include two tubular segments 54 separated by an isolation assembly 52. The tubular segment 54 vertically above the isolation assembly 52 may have a cross-sectional area that is larger than the successively lower tubular segment 54. The degree of difference between the successive tubular segments 54 may vary depending on the expected production rates of the successive isolation zones 62 and the expected increased mass flow rate in the successively higher tubular segment 54. Additionally or alternatively, the increased cross-sectional area may consider the varied density of the fluids in the tubular string inner conduit as the fluid flows upward.

In the exemplary representation of FIG. 9, the cross-sectional area of the tubular string 26 changes after each isolation assembly, which may be appropriate in implementations where the isolation assembly 52 is configured to couple adjacent tubular joints together. Additionally or alternatively, the cross-sectional area may change at the junction of any two tubing joints, such as where a particular isolation zone 62 is long enough that the fluid density in the tubular string will change sufficiently before the next isolation zone. Similarly, in some implementations a single isolation zone 62 may include two or more vertically spaced-apart openings 56 and the tubular string cross-sectional area may vary within an isolation zone. In some implementations, the increased cross-sectional areas are implemented primarily to accommodate the increased mass flow rate associated with an opening 56. In such implementations, the transitions, whether by way of conventional collars or by way of an isolation assembly, are configured to occur in close proximity to the openings 56 such as illustrated in FIG. 9. While FIG. 9 illustrates a changed cross-sectional area at each successive isolation zone 62, other implementations may maintain a constant cross-sectional area across two or more isolation zones and vary the cross-sectional area at fewer than all of the isolation zones. Other variations on these principles will be appreciated by those of ordinary skill.

Figure 10B:
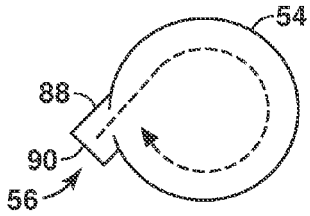
FIGS. 10A and 10B illustrate a side and top view respectively of a vortex-inducing nozzle that may be provided in an isolation system.
Figure 10A:
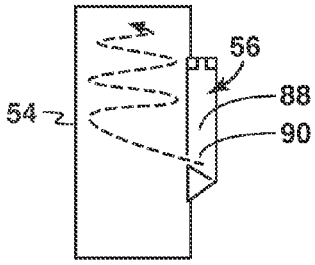

In some implementations, the openings 56 may be adapted to do more than just open or close, partially or completely. For example, the openings 56 may be adapted to direct the fluid flow in a particular manner as it enters the inner conduit of the tubular 26. FIGS. 10A and 10B, for example, illustrate a vortex-inducing nozzle 90 that directs the incoming fluid flow tangentially. Vortex flow is known to reduce hydrostatic pressure for a short distance from the point at which it is induced. The reduced hydrostatic pressure has many effects, including increasing the wellbore/tubular pressure difference, increasing the fluid velocity entering the tubular, increasing production in the isolation zone, etc. Conventionally, operators have attempted to induce vortices using expensive or difficult auxiliary equipment. In implementations of the present technology, vortex flow can be induced within each isolation zone by relatively minor adaptations of the openings 56. While the vortex-inducing nozzle 90 is illustrated in FIGS. 10A and 10B as a mandrel-type configuration, vortex flow may also be induced through configured orifices or other means.

Figure 11:
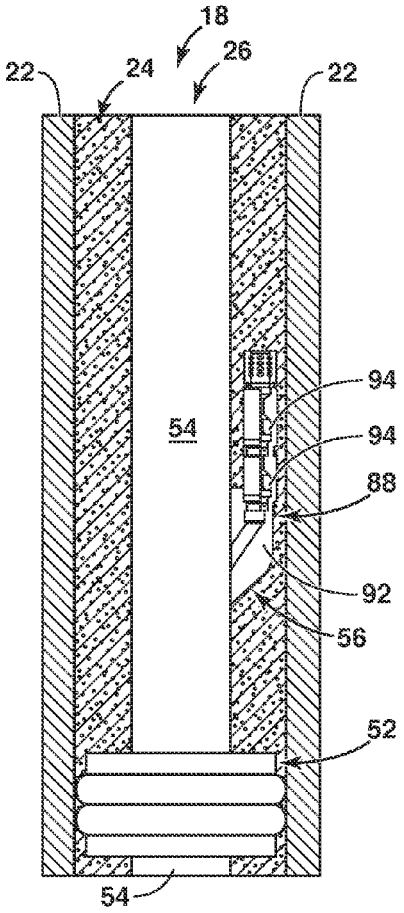
FIG. 11 illustrates another configuration of an opening to the tubular segment.

FIG. 11 illustrates yet another implementation of the present technology showing a flow regulator 88 in schematic, partial cross-sectional view. As with the implementations of FIGS. 9 and 10, the isolation system 50 of FIG. 11 includes a tubular segment 54, an isolation assembly 52, and an opening 56. The opening 56 may be configured as a valve mandrel 92 having one or more check valves 94 disposed therein. The check valves 94 may be any suitable check valve, including commercially available check valves. Check valves, or other one-way flow regulators, may be preferred in some implementations to keep fluid in the inner conduit from exiting into the wellbore annulus of a particular isolation zone. As illustrated, some implementations may include two or more check valves 94 in series for redundancy. As discussed above, the flow regulators 88 may include or be adapted to provide any one or more features commonly available in downhole operations; the representative illustration of check valves 94 in valve mandrel 92 is exemplary only.

Figure 12:
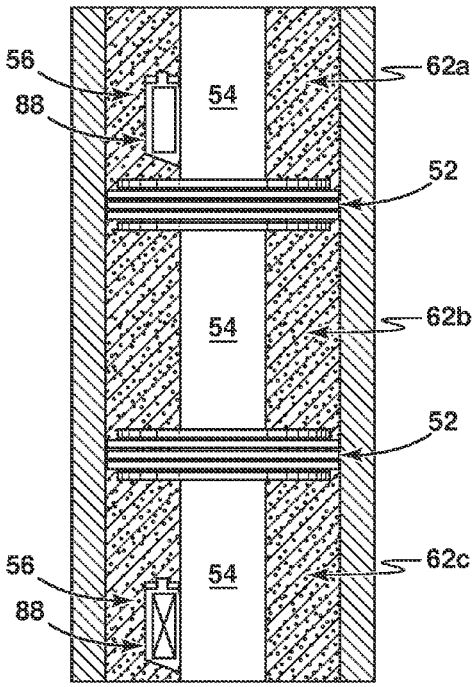
FIG. 12 illustrates various configurations of sequential isolation systems as may occur during operation of a well provided with the present isolation systems.

FIG. 12 illustrates still further exemplary implementations of the present technology. In the implementation of FIG. 12, the tubular string 26 includes three tubular segments 54, two of which include openings 56, and two isolation assemblies 52. The illustration of FIG. 12 is a limited portion of the wellbore and other isolation assemblies and/or equipment may be utilized in the remainder of the wellbore. Either one or both of the isolation assemblies 52 of FIG. 12 may be configured or implemented as leaky isolation assemblies 60. FIG. 12 illustrates a scenario that may occur during production operations utilizing the present technology. The lower two isolation zones 62*b*, 62*c* are producing undesirable levels of some undesired component, such as water, sand, or other component, while the uppermost isolation zone 62*a* is producing according to the desired expectations. FIG. 12 shows various responses that may be available to the operator under such circumstances. For example, the opening 56 in the lowermost isolation zone 62*c* has been modified in situ (such as by wireline operations or through self-adaptive technologies) to close the opening when the production in the isolation zone meets some condition, such as excessive water production. Additionally or alternatively, the middle isolation zones 62*b* illustrates that an isolation zone may be modified to remove, or otherwise close, the opening 56, such as by using sliding sleeve technology or other suitable technology.

It will be appreciated that closing the opening 56 such as illustrated in FIG. 12 affects the operation of the isolation zone and the leaky isolation assembly 60. As discussed above, the leaky isolation assemblies 60 are configured to restrict flow past the isolation assembly creating a preferred flow path into the opening 56. Once the opening has been closed, as in FIG. 12, the only flow path remaining is past the isolation assembly 60. However, the leaky isolation assembly does at least partially block the wellbore annulus 24, and in some implementations, the leaky isolation assembly includes restriction disks 74 that substantially restrict flow in the wellbore annulus. Accordingly, while flow from the water producing isolation zones 62*b*, 62*c* will not be completely prevented by the leaky isolation assemblies 60, the flow from these closed isolation zones into the open isolation zone 62*a* will be limited and in some implementations significantly reduced.

Similarly, tubular segments 54 lacking openings 56 may be disposed in the tubular string between isolation assemblies 52 and/or leaky isolation assemblies 60. For example, a portion of the producing interval 14 may be known or believed to be unsuitable for a producing zone (such as being an extended length of non-producing formation). While the leaky isolation assemblies 60 may allow fluids to enter and/or exit the zones associated with a tubular segment lacking an opening, the flow will be substantially restricted or reduced. In wellbores where the installation of numerous packers is technically or economically infeasible, such implementations of leaky isolation assemblies may sufficiently reduce flow in these blocked isolation zones.

Figures 13A, 13B, 13C, 13D:
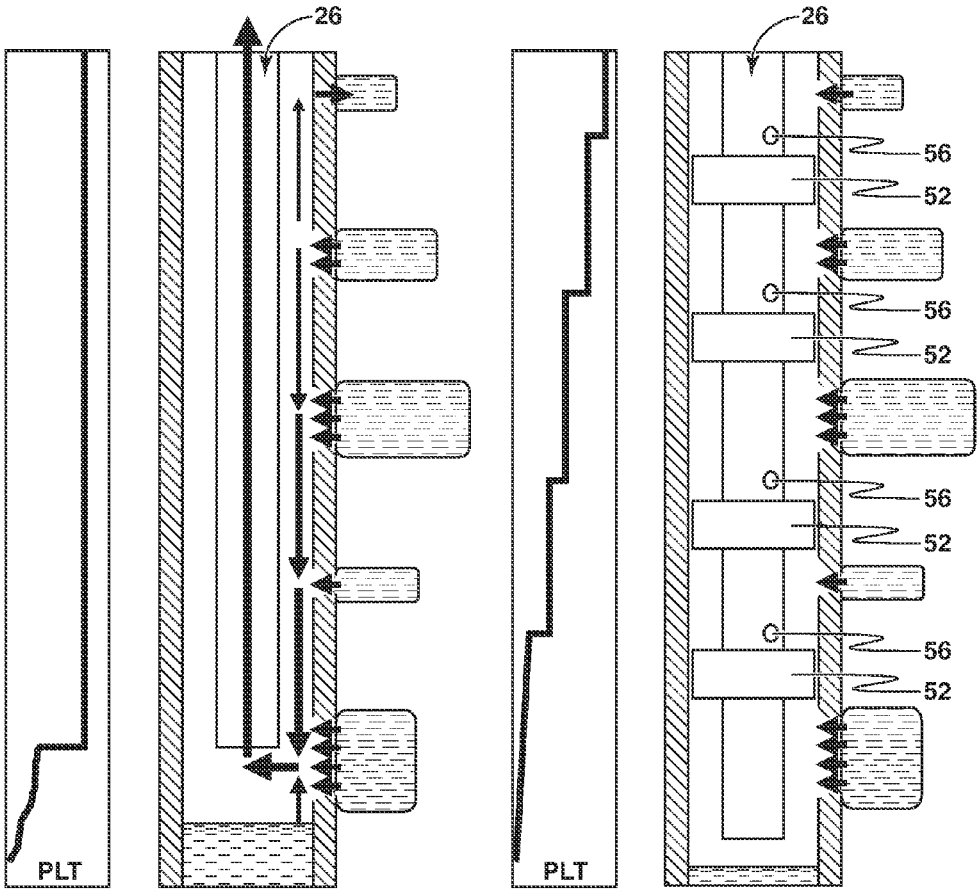
FIG. 13A illustrates PLT results when run in a conventional tubing string.
FIG. 13B illustrates PLT results when run in a conventional tubing string.
FIG. 13C illustrates PLT results available when run in a tubing string equipped with isolation systems according to the present disclosure.
FIG. 13D illustrates PLT results available when run in a tubing string equipped with isolation systems according to the present disclosure.

Wellbore operations are planned based on various properties of the formation that can affect fluid flow patterns along the length of the wellbore. As the properties of the formation along the length of the wellbore generally vary, flow rates also vary along the length. Wellbore planning typically includes measuring fluid flow properties at as many locations as possible along the wellbore. Conventionally, such measurements are gathered by a Production Log Test (PLT), in which equipment is lowered into the wellbore before tubing is installed and measurements are collected at various locations along the wellbore identifying the zones of the wellbore having different fluid flow properties. These PLT measurements prior to tubing installation are generally acceptable for determining fluid flow properties at a given point in time. However, they are incapable to measuring or describing the properties or performance of the different zones once the tubing is installed and production (or injection) begins. Once the tubing is installed, all of the zones behind the tubing are comingled before entering the tubing, as shown in FIG. 13B, and becoming accessible to the measuring tools. Accordingly, PLT measurements taken with the tubing installed appears something like the chart in FIG. 13A showing no variation along the length of the tubing even though the fluid flow from the formation varies substantially.

FIG. 13C-13D, however, illustrates that the technology of the present disclosure may enable PLT measurements during the life of the well, taken from within the tubing string 26, to measure production from the individual zones. As is conventional in PLT tests, measurement equipment is lowered into the wellbore, such as on a wireline. In accordance with the implementation of FIG. 13C-13D, the equipment is lowered into the wellbore within the tubular string 26. The equipment is then withdrawn up through the tubular taking measurements along the way, which measurements are schematically illustrated in FIG. 13C. Due to the multiple inputs into the tubular inner conduit, the measurements collected by the PLT equipment are able to record the different production conditions in each of the isolation zones 62.

The measurements schematically illustrated in FIG. 13C show the step changes that may occur at the different openings 56. In reality, the measurements may not be plotted by the PLT equipment in such fine detail or clear step changes, however, the schematic representation of FIG. 13D reveals the clarity that can be developed after the data from the equipment is processed and analyzed by those skilled in the art. Advantageously, the isolation systems of the present disclosure may enable PLT measurements to be taken at various times during the life of the well, which may help operators to understand how the formation is changing as the production/injection progresses. PLT data collection during ongoing production/injection operations may enable operators to vary the operations within particular isolation zones so as to better control the operations for maximum performance over the expected life of the well. For example, specific actions may be taken on particular zones via wireline or coiled tubing operations to perform workover operations and/or to activate downhole hardware. For example, the hardware associated with one or more of the openings 56 may be adjusted.

The principles of the present invention may be applied in a variety of implementations, including one or more combinations of the features and elements described above. The disclosure herein describes various implementations including one or more disks, collars, or other elements disposed around a tubular to provide a leaky isolation assembly segmenting the wellbore annulus. However, the use of an element circumscribing a tubular element is not required by the present invention and suitable variations will be recognized by those of skill in the art utilizing any variety of downhole equipment sized and/or configured to provide the leaky isolation assemblies described herein. As one exemplary extension of the present principles, expandable tubulars may be customized to expand at predetermined locations and in predetermined manners to provide the leaky isolation of the present invention. Expandable tubulars are available from a number of sources and their ability to expand in predetermined manners is readily understood. Other downhole equipment may be identified that can be configured to provide the leaky isolation described and claimed herein.

While the present techniques of the invention may be susceptible to various modifications and alternative forms, the exemplary embodiments discussed above have been shown by way of example. It should be understood that the invention is not intended to be limited to the particular embodiments disclosed herein. The subject matter of the present invention (s) includes all novel and non-obvious combinations and subcombinations of the various elements, features, functions and/or properties disclosed herein. Where the disclosure or claims recite "a" or "a first" element or the equivalent thereof, it is within the scope of the present inventions that such disclosure or claims may be understood to include incorporation of one or more such elements, neither requiring nor excluding two or more such elements. Similarly, where the above disclosure refers to "a first" element (or portion of an element) and "a second" element (or portion of an element), such descriptions are understood to be used merely for distinguishing similar elements or portions of elements rather than for specific references to order or arrangement of the elements (or portions of elements). Indeed, the present techniques of the invention are to cover all modifications, equivalents, and alternatives falling within the spirit and scope of the invention as defined by the following appended claims.

What is claimed is:

1. A zonal isolation system for use in a wellbore, the zonal isolation system comprising:

a tubular segment having an opening defined therein and comprising a first end and a second end;

a first isolation assembly adapted to connect to the first end of the tubular segment and adapted to include an outer diameter portion having at least one restriction member selected to have an outer diameter between about 90% and about 110% of a drift diameter of the wellbore to block at least a portion of a wellbore annulus between the tubular segment and a wellbore wall when in a wellbore, and wherein the isolation assembly comprises (i) a coupling tubular adapted to be coupled to one or more tubular segments, and (ii) at least one restriction member in sliding association with the coupling tubular for movement along a length of the coupling tubular; and a second isolation assembly adapted to connect to the second end of the tubular segment and adapted to include an outer diameter portion having at least one restriction member selected to have an outer diameter between about 90% and about 110% of the drift diameter of the wellbore to block at least a portion of the wellbore annulus between the tubular segment and the wellbore wall when in the wellbore;

wherein at least one of the first isolation assembly and the second isolation assembly does not include a wellbore sealing member and the at least one of the first isolation assembly and the second isolation assembly cooperates with the opening to form an isolation zone having at least two outlets including a first outlet through the opening and a second outlet past an outermost surface of the outer diameter portion of the restriction member of at least one of the first and second isolation assembly;

wherein the isolation zone is configured to have hydraulics during operation driving at least a majority by volume of the fluids through the first outlet and at least substantially restricting but not preventing fluid from passing the outer circular surface of the isolation assembly, and wherein the tubular segment is completely above or below the isolation assembly.

2. The zonal isolation system of claim 1 wherein the at least one restriction member has a deformable configuration that deforms at one or more of predetermined pressures and predetermined temperatures to allow fluid flow in both directions past the at least one restriction member.

3. The zonal isolation system of claim 1 wherein the at least one restriction member has a deformable configuration selected to enable the isolation assembly to be pigged into the wellbore.

4. The zonal isolation system of claim 1 wherein the at least one restriction member comprises a bi-directional barrier having an at least substantially symmetrical configuration.

5. The zonal isolation system of claim 1 wherein the tubular segment includes one or more tubular joints.

6. The zonal isolation system of claim 5 wherein at least one of the one or more tubular joints has a length selected to provide a production zone of a desired length shorter than a production interval length in which the zonal isolation system will be disposed.

7. The zonal isolation system of claim 1 wherein the at least one restriction member comprises at least one restriction disk circumscribing the coupling tubular.

8. The zonal isolation system of claim 7 further comprising at least one support disk associated with the at least one restriction disk.

9. The zonal isolation system of claim 1 wherein the opening in the tubular segment is selectively configurable.

10. The zonal isolation system of claim 9 wherein the opening is selectively configurable when in the wellbore.

11. The zonal isolation system of claim 9 wherein the opening includes a flow regulator adapted to control fluid flow through the opening.

12. The zonal isolation system of claim 11 wherein the flow regulator is selected from a check valve, a sand screen, a vortex-inducing nozzle, a calibrated orifice, a sliding sleeve, and an actuated valve.

13. The zonal isolation system of claim 1 further comprising two or more segmentation units, wherein each of the two or more segmentation units comprises at least one tubular segment and at least two isolation assemblies having at least one of the two isolation assemblies configured as an isolation assembly, wherein the two or more segmentation units are adapted to be in a wellbore interval segmenting the wellbore interval into two or more zones.

14. The zonal isolation system of claim 13 wherein the at least one tubular segment of at least one of the two or more segmentation units includes an opening.

15. The zonal isolation system of claim 1 wherein at least one of the first and second isolation assemblies comprises at least one restriction element associated with a body member, wherein the body member is further adapted to couple to the tubular segment.

16. The zonal isolation system of claim 15 wherein the at least one restriction element comprises a pigging disk.

17. The zonal isolation system of claim 1 wherein the opening is formed after the tubular segment is in the wellbore.

18. The zonal isolation system of claim 1 wherein the opening is in a lower end region of the isolation zone.

19. The zonal isolation system of claim 1 wherein the opening is at a lower end of the tubular segment.

20. An isolation system for use in a wellbore, the isolation system comprising:

one or more tubular segments, wherein each of the one or more tubular segments defines an inner conduit and defines a wellbore annulus between the tubular segment and a wellbore wall when the tubular segment is in a wellbore; and at least one isolation assembly operatively associated with at least one of the one or more tubular segments; wherein the at least one isolation assembly is adapted to include an outer diameter portion having at least one restriction member selected to have an outer diameter between about 90% and about 110% of a drift diameter of the wellbore to block at least a portion of the wellbore annulus between the at least one isolation assembly and the wellbore wall, and wherein the at least one isolation assembly comprises (i) a coupling tubular adapted to be coupled to a first tubular segment and a second tubular segment, and (ii) at least one restriction element circumscribing the coupling tubular, and wherein the at least one restriction element is in sliding association with the coupling tubular for movement along a length of the coupling tubular;

wherein at least one of the one or more tubular segments comprises an opening defined therein providing fluid communication between the wellbore annulus and the inner conduit;

wherein the at least one isolation assembly does not include a wellbore sealing member and the at least one isolation assembly separates the wellbore annulus into at least two isolated zones when in the wellbore, the at least one isolation assembly provides a fluid flow path from the isolation zone between an outermost surface of the at least one restriction member and the wellbore wall.

21. The isolation system of claim 20 wherein the at least one isolation assembly is coupled between two tubular segments adapted to maintain at least a predetermined velocity within the two tubular segments.

22. The isolation system of claim 21 wherein the inner conduits of the two tubular segments have different cross-sectional areas.

23. The isolation system of claim 20 wherein the at least one restriction element is between a first stop and a second stop.

24. The isolation system of claim 23 further comprising a first collar adapted to connect the coupling tubular to the first tubular segment and a second collar adapted to connect the coupling tubular to the second tubular segment, and wherein the first collar and the second collar comprise the first stop and the second stop.

25. The isolation system of claim 20 wherein the at least one restriction element comprises at least one restriction disk circumscribing the coupling tubular and adapted to contact the coupling tubular and the wellbore wall when in the wellbore.

26. The isolation system of claim 20 wherein the at least one restriction element further comprises at least one support disk between the at least one restriction disk and at least one of the first tubular segment and the second tubular segment.

27. The isolation system of claim 20 wherein the at least one restriction disk is configured as a pigging disk.

28. The isolation system of claim 20 wherein the at least one restriction disk is configured as a bi-directional pigging disk.

29. The isolation system of claim 20 wherein the opening in the at least one of the one or more tubular segments is formed after the at least one of the one or more tubular segments is in the wellbore.

30. The isolation system of claim 20 wherein the opening is in a lower end region of an isolation zone.

31. The isolation system of claim 20 wherein the at least one isolation assembly comprises at least one restriction member having a deformable configuration that deforms at one or more of predetermined pressures and predetermined temperatures to allow fluid flow in both directions past the at least one restriction member.

32. The isolation system of claim 31 wherein the at least one restriction member has a deformable configuration selected to enable the at least one isolation assembly to be pigged into the wellbore.

33. The isolation system of claim 31 wherein the at least one restriction member comprises a bi-directional barrier having an at least substantially symmetrical configuration.

34. A method for use in hydrocarbon wells, the method comprising:

providing a tubular segment having at least one opening in the tubular segment that provides fluid communication between an inner conduit of the tubular segment and a wellbore annulus between the tubular segment and a wellbore wall when the tubular segment is in a wellbore; and operatively associating an isolation system with the tubular segment, wherein the isolation system does not include a wellbore sealing member and the isolation system is adapted to include an outer diameter portion having an outer diameter between about 90% and about 110% of a drift diameter of the wellbore to block at least a portion of the wellbore annulus between the tubular segment and the wellbore wall when in the wellbore to cause at least a majority by volume of the fluid in the wellbore annulus to enter the tubular segment through the at least one opening in the tubular segment while allowing at least a portion of the wellbore fluid to pass an outermost surface of the outer diameter portion of the isolation system under wellbore operational conditions, wherein the opening is in operative association with the isolation assembly to induce flow through the opening and to limit flow past the isolation assembly, and wherein the at least one isolation assembly comprises (i) a coupling tubular adapted to be coupled to a first tubular segment and a second tubular segment, and (ii) at least one restriction element circumscribing the coupling tubular, and wherein the at least one restriction element is in sliding association with the coupling tubular for movement along a length of the coupling tubular;

wherein a number and location of the at least one opening are selected based at least in part on one or more of minimizing liquid accumulation in a production zone, minimizing pressure drop in the production zone, and maximizing flow velocity into the tubular segment.

35. The method of claim 34 wherein the tubular segment has a first end and a second end, and wherein the isolation assembly is connected to each of the first end and the second end of the tubular segment to form a segmentation unit.

36. The method of claim 35 wherein the tubular segment comprises at least one joint having a length selected to provide a segmentation unit length shorter than an interval length within which the segmentation unit is when in the wellbore.

37. The method of claim 35 further comprising providing a plurality of segmentation units coupled together to form part of a tubular string and to separate a wellbore interval into a plurality of zones.

38. The method of claim 34 wherein the isolation system is within a wellbore interval to at least substantially block the wellbore annulus between the isolation system and the wellbore wall dividing the wellbore annulus into at least two production zones.

39. The method of claim 38 wherein the tubular segment is configured to provide a corresponding production zone adapted to minimize liquid accumulation within the production zone.

40. The method of claim 38 wherein the tubular segment is configured to provide a corresponding production zone adapted to minimize cross-flow between production zones within the wellbore.

41. The method of claim 38 wherein the tubular segment is configured to provide a corresponding production zone adapted to minimize pressure drop in the production zone.

* * * * *